US009920973B2

(12) United States Patent
Luo

(10) Patent No.: US 9,920,973 B2
(45) Date of Patent: Mar. 20, 2018

(54) AIR CONDITIONER EXHAUST RECYCLING

(75) Inventor: Dong Luo, South Windsor, CT (US)

(73) Assignee: CARRIER CORPORATION, Farmington, CT (US)

( * ) Notice: Subject to any disclaimer, the term of this patent is extended or adjusted under 35 U.S.C. 154(b) by 697 days.

(21) Appl. No.: 14/114,229

(22) PCT Filed: Apr. 26, 2012

(86) PCT No.: PCT/US2012/035127

§ 371 (c)(1),
(2), (4) Date: Jan. 14, 2014

(87) PCT Pub. No.: WO2012/149112

PCT Pub. Date: Nov. 1, 2012

(65) Prior Publication Data

US 2014/0144176 A1 May 29, 2014

Related U.S. Application Data

(60) Provisional application No. 61/480,511, filed on Apr. 29, 2011.

(51) Int. Cl.

| | |
|---|---|
| ***F24F 3/00*** | (2006.01) |
| ***F24F 7/02*** | (2006.01) |
| ***F24F 13/20*** | (2006.01) |
| ***F24F 3/04*** | (2006.01) |
| ***F24F 3/10*** | (2006.01) |

(Continued)

(52) U.S. Cl.
CPC ..... *F25D 17/06* (2013.01); *F24F 3/044* (2013.01)

(58) Field of Classification Search
CPC F25B 20/00; F25B 20/02; F25B 20/06; F24F 3/001; F24F 3/04; F24F 3/10; F24F 3/052; F24F 2007/005; F24F 7/02; F24F 7/025; F24F 7/04; F24F 7/08; F24F 12/00; F24F 12/002; F24F 2012/007; F24F 2012/008; F24F 13/20; F24D 5/04
See application file for complete search history.

(56) References Cited

U.S. PATENT DOCUMENTS

| | | | |
|---|---|---|---|
| 2,100,834 | A | 11/1937 | Chapman |
| 2,932,177 | A | 4/1960 | Brennan |
| 3,496,992 | A | 2/1970 | Leonard |

(Continued)

FOREIGN PATENT DOCUMENTS

| | | | |
|---|---|---|---|
| DE | 2536124 | A1 | 2/1977 |
| EP | 0913283 | A1 | 5/1999 |

(Continued)

OTHER PUBLICATIONS

PCT International Preliminary Report on Patentability and Written Opinion of the International Searching Authority for International Application No. PCT/US2012/035127, dated Nov. 7, 2013, 7 pages.

*Primary Examiner* — Frantz Jules
*Assistant Examiner* — Erik Mendoza-Wilkenfel
(74) *Attorney, Agent, or Firm* — Cantor Colburn LLP

(57) ABSTRACT

An air conditioning system includes an air conditioning portion configured to condition a volume of air flowing there-through and an exhaust portion configured to exchange heat with the air conditioning portion through a working fluid. A portion of the volume of air exiting the air conditioning portion is mechanically diverted into the exhaust portion.

9 Claims, 5 Drawing Sheets

(51) Int. Cl.
*F25D 17/06* (2006.01)
*F24F 3/044* (2006.01)

(56) References Cited

U.S. PATENT DOCUMENTS

| | | | | | |
|---|---|---|---|---|---|
| 3,635,445 | A | | 1/1972 | Schwab et al. | |
| 3,867,979 | A | * | 2/1975 | Carrasse | F24F 3/001 165/62 |
| 4,176,525 | A | | 12/1979 | Tucker et al. | |
| 4,227,378 | A | * | 10/1980 | Thoren | F24F 3/001 62/265 |
| 4,580,401 | A | | 4/1986 | Ruscheweyh | |
| 4,995,307 | A | * | 2/1991 | Floyd | F24F 3/044 454/255 |
| 4,996,850 | A | | 3/1991 | Boxum et al. | |
| 6,131,402 | A | | 10/2000 | Mills, Jr. et al. | |
| 6,354,101 | B1 | | 3/2002 | Levitin et al. | |
| 6,751,972 | B1 | | 6/2004 | Jungwirth | |
| 7,269,965 | B2 | | 9/2007 | Kim et al. | |
| 2004/0045304 | A1 | * | 3/2004 | Park | F24F 1/022 62/183 |
| 2011/0308265 | A1 | * | 12/2011 | Phannavong | F24F 12/001 62/160 |
| 2012/0247132 | A1 | * | 10/2012 | Lakdawala | F24F 5/0071 62/79 |

FOREIGN PATENT DOCUMENTS

| | | | | |
|---|---|---|---|---|
| GB | 831088 | A | | 3/1960 |
| JP | 2000146283 | A | * | 5/2000 |

* cited by examiner

AIR CONDITIONER EXHAUST RECYCLING

BACKGROUND OF THE INVENTION

The present invention is directed to air-conditioning systems, and more particularly, example embodiments of the present invention are directed to exhaust recycling in air-conditioning systems.

Conventional air conditioning systems suffer from energy inefficiencies during cooling or heating cycles responsive to an ambient temperature of air/fluid flowing over a condenser or evaporator of the air conditioning system, respectively. For example, during operation of a heating-cycle of an air conditioner, the cooler the ambient temperature of air/fluid flowing over the evaporator, the more inefficient a heat pump becomes. Further, during operation of a cooling-cycle of an air conditioner, the hotter the ambient temperature of air/fluid flowing over the condenser, the more inefficient the air conditioner becomes.

BRIEF DESCRIPTION OF THE INVENTION

According to an example embodiment of the present invention, an air conditioning system includes an air conditioning portion configured to condition a volume of air flowing there-through and an exhaust portion configured to exchange heat with the air conditioning portion through a working fluid. A portion of the volume of air exiting the air conditioning portion is mechanically diverted into the exhaust portion.

According to another example embodiment of the present invention, an air conditioning system includes a housing which defines an air conditioning portion configured to condition air entering and flowing there-through, an exhaust portion configured to exchange heat with the air conditioning portion through a working fluid, and a diversion channel proximate the air conditioning portion and the exhaust portion. The diversion channel is arranged to divert a portion of air entering the air conditioning portion to the exhaust portion.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

According to example embodiments, air conditioning systems with exhaust recycling are provided, which redirect exhaust to either an evaporator or condenser of the air conditioning systems. The technical effects include increased energy efficiency during operation of the air conditioning system in either a heat-pump or cooling mode.

Figure 1:
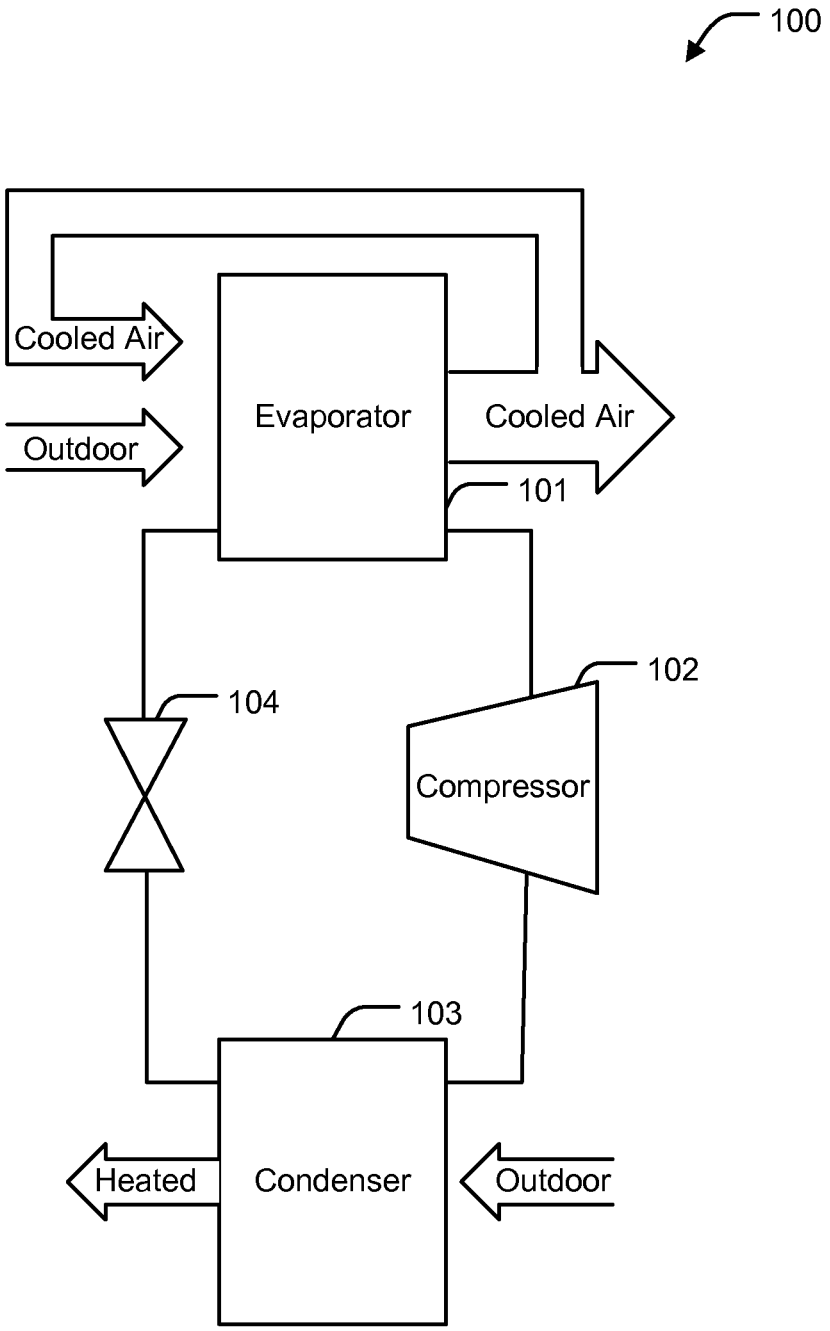
FIG. 1 depicts a conventional air conditioning system in cooling mode.

Turning to FIG. 1, a conventional air conditioning system is depicted. The system 100 includes an evaporator 101. The system 100 further includes compressor 102 in fluid communication with the evaporator 101. The system 100 further includes condenser 103 in fluid communication with the compressor 102. The system 100 further includes expansion valve 104 in fluid communication with the condenser 103 and the evaporator 101. As illustrated, a conventional refrigeration cycle is produced where refrigerant is exchanged between the evaporator 101 and condenser 103 in a manner which allows heat to be exchanged with air flowing over the evaporator 101 and condenser 103.

For example, condenser 103 exchanges heat with outdoor air flowing there-through. Further, outdoor air exchanges heat with the evaporator 101 as it flows there-through. Moreover, a portion of the cooled air exiting the evaporator 101 is diverted after flowing through a conditioned space and mixed with outdoor air which flows through the evaporator 101. In this manner, heat is removed from the cooled-air/outdoor air mix entering the evaporator 101 and is exchanged with outdoor air flowing through the condenser 103.

It is apparent that as the ambient temperature of outdoor air entering the condenser 103 increases, the flow of heat from the condenser 103 to the outdoor air decreases. More clearly, there is a net decrease in temperature differential, thereby reducing the availability of a heat sink produced by the outdoor air. However, example embodiments provide for a decrease in the temperature of air entering a condenser, thereby increasing the temperature differential and decreasing energy consumption of an exemplary air conditioning system.

Figure 2:
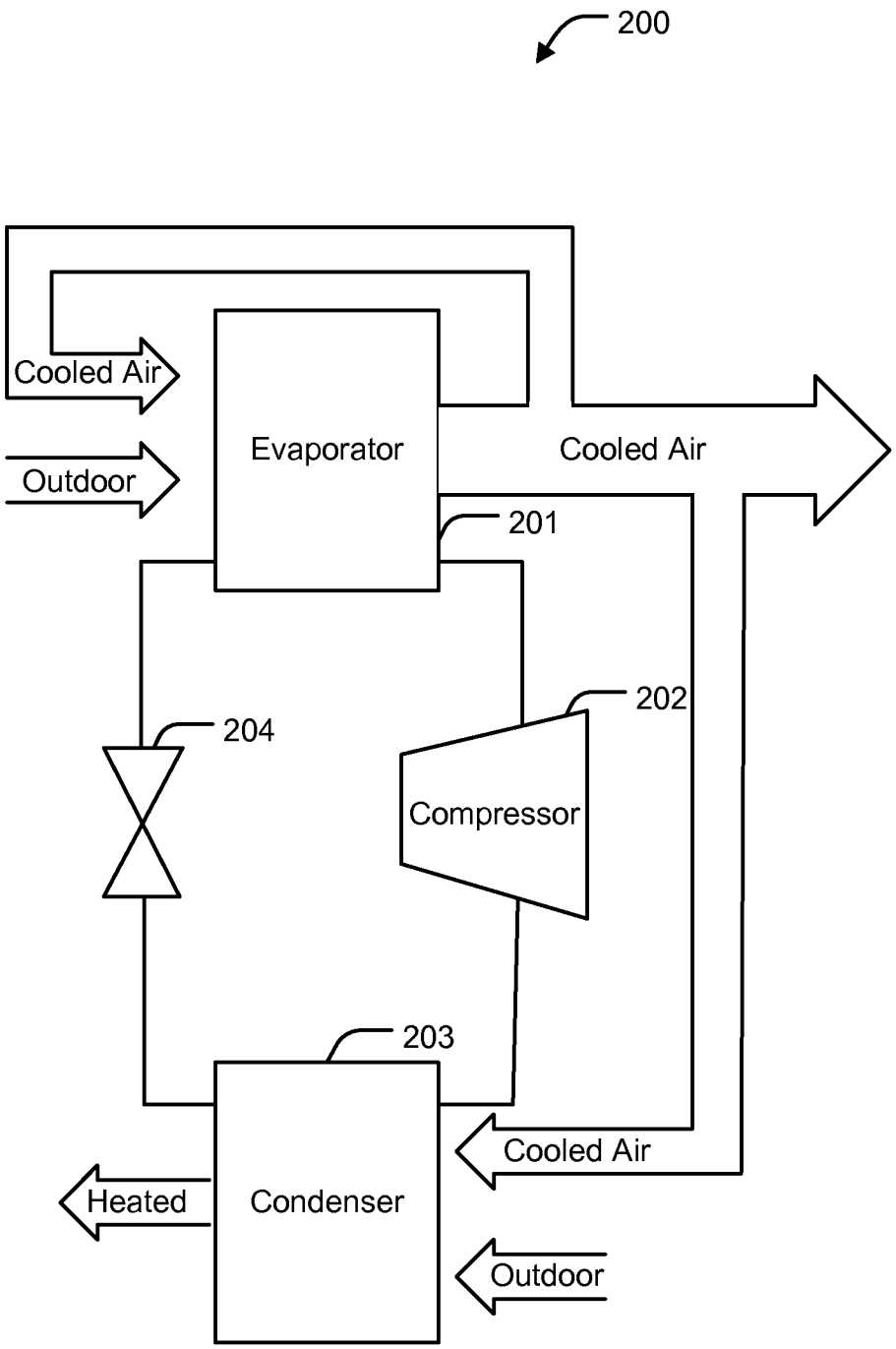
FIG. 2 depicts an air conditioning system in cooling mode, according to an example embodiment.

For example, FIG. 2 depicts an air conditioning system, according to an example embodiment. The system 200 includes an evaporator 201. The system 200 further includes compressor 202 in fluid communication with the evaporator 201. The system 200 further includes condenser 203 in fluid communication with the compressor 202. The system 200 further includes expansion valve 204 in fluid communication with the condenser 203 and the evaporator 201. It is noted that although system 200 is illustrated with a particular number and type of components, example embodiments do not preclude the addition of any suitable components and/or omission of components according to any desired implementation.

As illustrated, a refrigeration cycle is produced where refrigerant is exchanged between the evaporator 201 and condenser 203 in a manner which allows heat to be exchanged with air flowing over the evaporator 201 and condenser 203. For example, condenser 203 exchanges heat with outdoor air flowing there-through. Further, outdoor air exchanges heat with the evaporator 201 as it flows there-through. Moreover, a portion of the cooled air exiting the evaporator 201 is diverted after flowing through a conditioned space and mixed with outdoor air which flows through the evaporator 201 and the condenser 203. In this manner, heat is removed from the recirculated air/outdoor air mix entering the evaporator 201 and is exchanged with a mixture of both outdoor air and recirculated air flowing through the condenser 203.

It is apparent that as the ambient temperature of outdoor air entering the condenser 203 increases, the recirculated air mixing with the outdoor air serves to mitigate a net temperature increase. More clearly, the temperature differential between refrigerant of the condenser 203 and the entering air is stabilized through diversion of the recirculated air, thereby maintaining the availability of a heat sink for heat exchange. Thus energy consumption of an air conditioning system is decreased compared to conventional systems.

Figure 3:
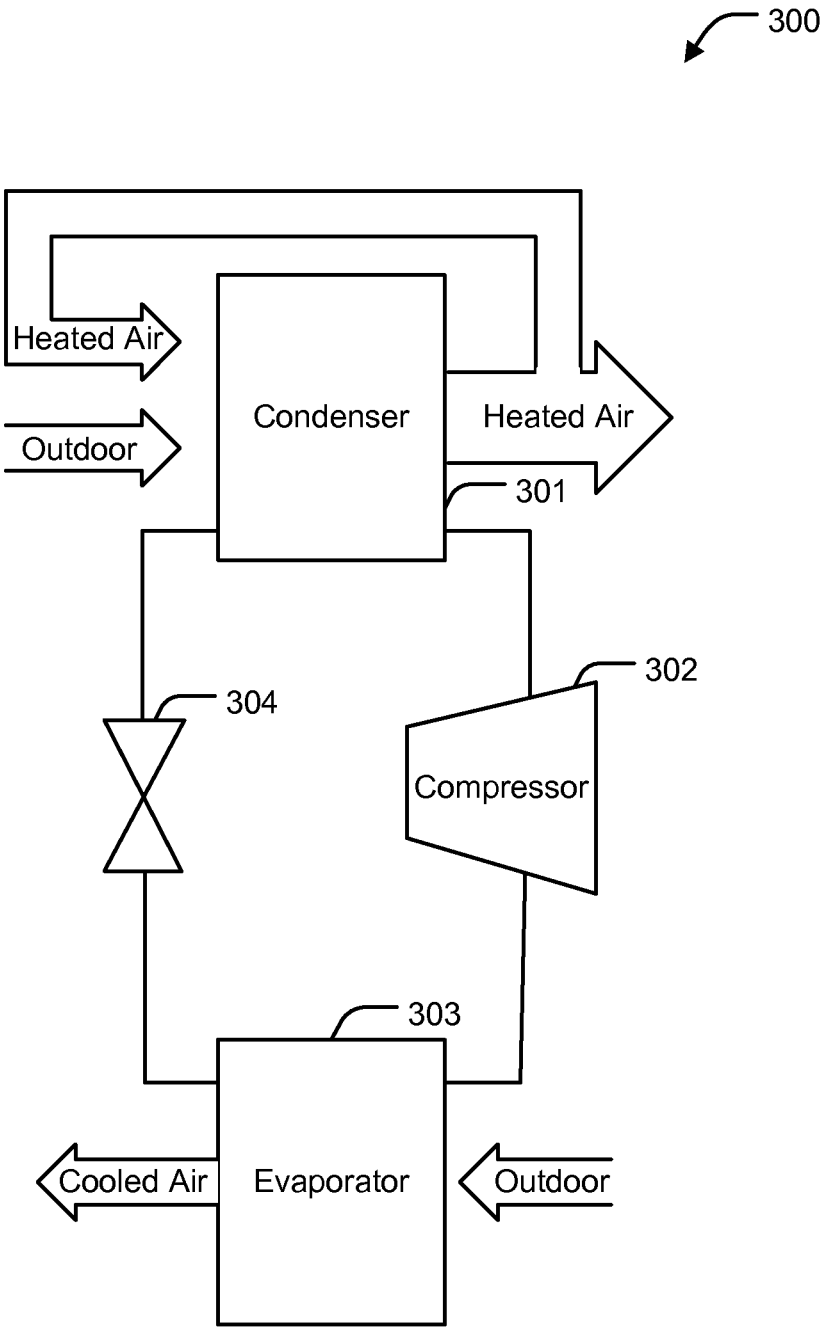
FIG. 3 depicts a conventional air conditioning system in heating mode.

In addition to increased efficiency of air conditioning systems during cooling-cycles described above, example embodiments provide increased efficiency during heating-cycles as well. For example, FIG. 3 depicts a conventional heat pump system. The system 300 includes a condenser 301. The system 300 further includes compressor 302 in fluid communication with the condenser 301. The system 300 further includes evaporator 303 in fluid communication with the compressor 302. The system 300 further includes expansion valve 304 in fluid communication with the condenser 301 and the evaporator 303. As illustrated, a conventional heating-cycle is produced where a working fluid is exchanged between the evaporator 303 and condenser 301 in a manner which allows heat to be exchanged with air flowing over the evaporator 303 and condenser 301.

For example, evaporator 303 removes heat from outdoor air flowing there-through. Further, outdoor air exchanges heat with the condenser 301 as it flows there-through. Moreover, a portion of the heated air exiting the condenser 301 is diverted after flowing through a conditioned space and mixed with outdoor air which flows through the condenser 301. In this manner, heat is removed from outdoor air flowing through the evaporator 303, which is added to the recirculated air/outdoor air mix entering the condenser 301.

It is apparent that as the ambient temperature of outdoor air entering the evaporator 303 decreases, the flow of heat to the evaporator 303 from the outdoor air decreases. More clearly, there is a net decrease in temperature differential, thereby reducing the availability of a heat source produced by the evaporator. However, example embodiments provide for an increase in the temperature of air entering an evaporator in a heat pump, thereby increasing the temperature differential and decreasing energy consumption of an exemplary heat pump system.

Figure 4:
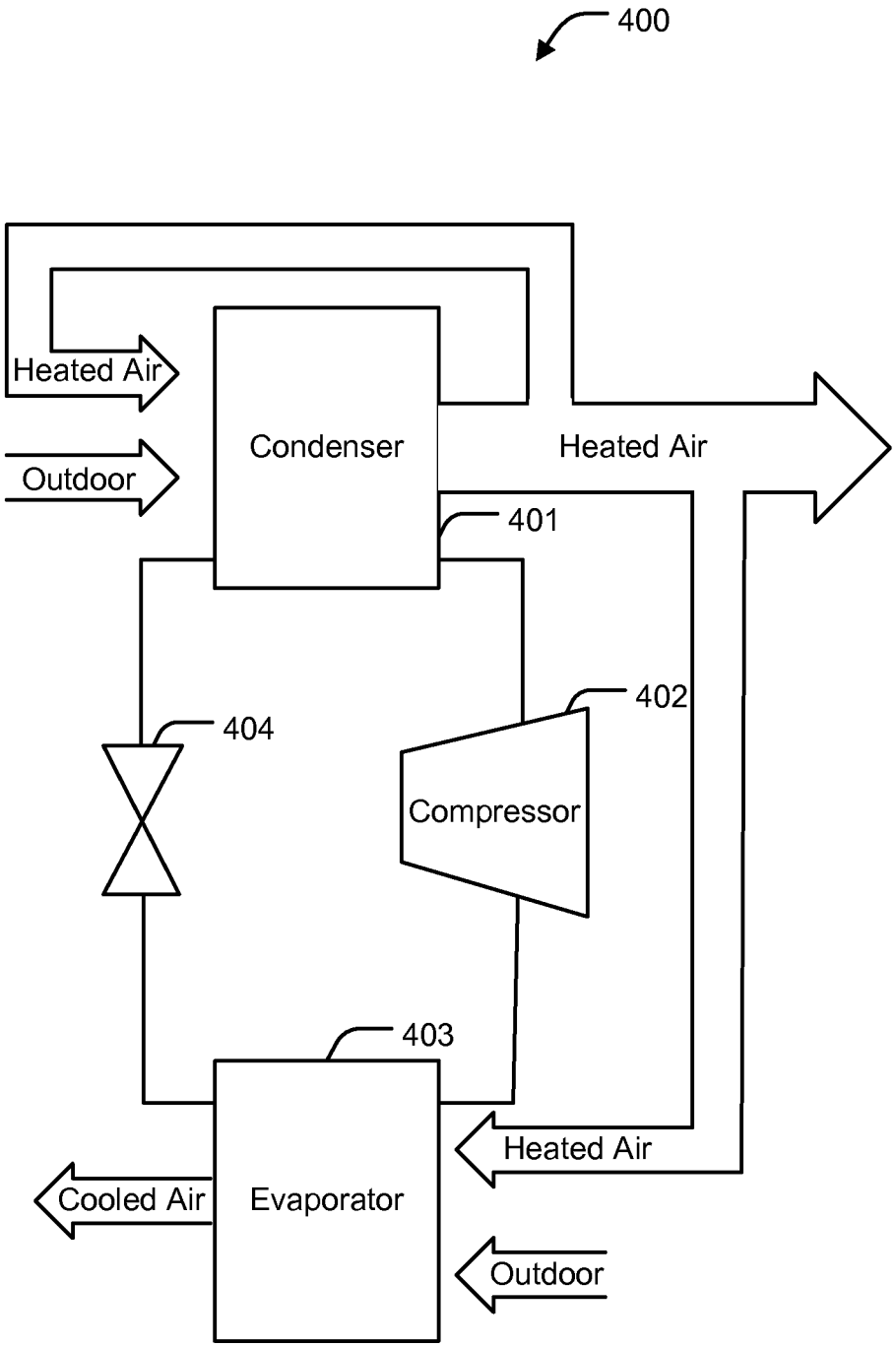
FIG. 4 depicts an air conditioning system in heating mode, according to an example embodiment.

For example, FIG. 4 depicts a heat pump system, according to an example embodiment. The system 400 includes a condenser 401. The system 400 further includes compressor 402 in fluid communication with the condenser 401. The system 400 further includes evaporator 403 in fluid communication with the compressor 402. The system 400 further includes expansion valve 404 in fluid communication with the condenser 401 and the evaporator 403. As illustrated, a conventional heating-cycle is produced where a working fluid is exchanged between the evaporator 403 and condenser 401 in a manner which allows heat to be exchanged with air flowing over the evaporator 403 and condenser 401.

For example, evaporator 403 removes heat from outdoor air flowing there-through. Further, outdoor air exchanges heat with the condenser 401 as it flows there-through. Moreover, a portion of the heated air exiting the condenser 401 is diverted after flowing through a conditioned space and mixed with outdoor air which flows through the condenser 401 and the evaporator 403. In this manner, heat is removed from the mixture of outdoor air and recirculated air flowing through the evaporator 403, which is added to the recirculated air/outdoor air mix entering the condenser 401.

It is apparent that as the ambient temperature of outdoor air entering the evaporator 403 decreases, the recirculated air mixing with the outdoor air serves to mitigate a net temperature decrease. More clearly, the temperature differential between refrigerant of the evaporator 403 and the outdoor air is stabilized through diversion of the recirculated air, thereby maintaining the availability of a heat source for heat exchange. Thus energy consumption of a heat pump system is decreased. It should also be noted that an added benefit of exemplary heat pump systems is the reduced possibility of heat pump failure due to an evaporator freezing out. Therefore, overall energy efficiency is further increased due to reduced necessity of running cyclic defrost cycles on the heat pump.

Although described as separate, it should be appreciated that the diversion of conditioned air, whether it is cooled or heated, in exemplary systems may be facilitated through at least one diversion channel due to the reversible nature of air conditioning systems. For example, as the operation of an evaporator in a system may be reversed, a single diversion channel serving to divert the conditioned air to the evaporator also serves to divert the conditioned air to the condenser when the system is operating in reverse. It should be appreciated that the opposite is also true. For example, an air conditioning system may be arranged to include an air conditioning portion and an exhaust portion, where conditioned air is diverted to the exhaust portion. In this example, if the system is run in reverse, the benefits of both FIGS. 2 and 4 are realized. Therefore, example embodiments should not be construed as limited to separate and distinct air conditioning and heat pump systems, but are extensible to any suitable combination.

Figure 5:
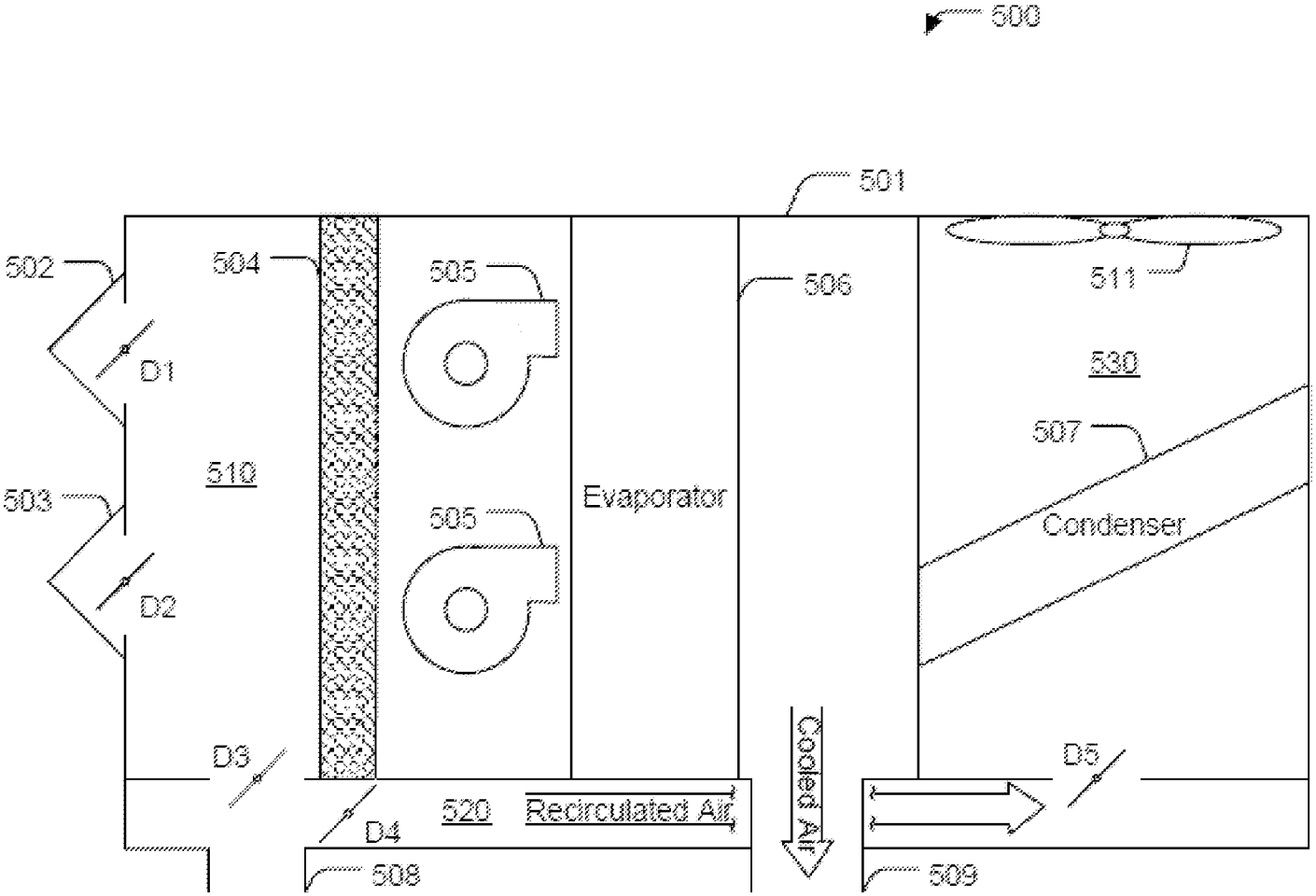
FIG. 5 depicts a diagram of an example roof-top air conditioning system, according to an example embodiment.

As a non-limiting example, a roof-top air conditioning system is illustrated in FIG. 5 which incorporates the benefits and features of example embodiments. Turning to FIG. 5, the system 500 may include a housing 501 configured to house components of the system 500. The housing 501 may include an air conditioning portion 510, a conditioned air diversion channel/duct 520, and an exhaust portion 530. The diversion channel 520 is configured to divert recirculated air entering the air conditioning portion 510 to the exhaust portion 530. For example, conditioned air leaves the air conditioning portion 510 to circulate in a conditioned environment, such as a building, refrigerator, freezer, transport container, etc. Upon circulating, the air reenters the air conditioning portion 510 to be mixed with outdoor air. Before mixing, a portion of the air flows through the diversion channel into the exhaust portion 530.

The flow of circulated conditioned air through the diversion channel 520 is facilitated by dampers D4 and D5. The damper D4 is proximate a first longitudinal end of the diversion channel 520, and the damper D5 is proximate a second longitudinal end of the diversion channel 520. Upon flowing through the diversion channel 520, the circulated conditioned air is forced through condenser 507 by fan(s) 511 in the exhaust portion 530. It is noted that at least one wall of the exhaust portion 520 may be finned or include apertures such that outdoor air is also forced through the condenser 507 by the fan(s) 511.

As further illustrated, the housing 501 further includes inlet port 502 configured to allow outdoor air to enter the air conditioning portion 510. The housing 501 further includes outlet port 503 configured to allow a portion of conditioned air to exit the system 500. In this manner, both outdoor air and conditioned air is mixed before being reconditioned. This aids in resupplying fresh air to the conditioned environment. Flow of outdoor air is facilitated and controlled with damper D1 which is proximate inlet port 502. The exit flow of circulated conditioned air is facilitated and controlled through damper D2 which is proximate the outlet port 503. Upon entering the air conditioning portion 510, the mixed outdoor/conditioned air is forced through filter 504 and evaporator 506 by fan(s) 505. Thereafter, the newly conditioned air mix flows to the conditioned environment.

As described above, conditioned air is recycled to stabilize a temperature within an exhaust portion of an air conditioning system. Although particularly illustrated as including an evaporator arranged in a conditioning portion and a condenser in the exhaust portion, it should be understood that upon operating in reverse, the roles of the evaporator and condenser change while still including all benefits outlined above.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An air conditioning system, comprising:

an air conditioning portion configured to condition air entering and flowing there-through, the air conditioning portion including a first heat exchanger for heating or cooling supply air supplied to a conditioned space, the air conditioning portion passing outside air and recirculated air from the conditioned space over the first heat exchanger to produce the supply air, an exhaust portion configured to exchange heat with the air conditioning portion through a working fluid, the exhaust portion including a second heat exchanger for exchanging heat with outdoor air, and a diversion channel proximate the air conditioning portion and the exhaust portion;

wherein the diversion channel diverts a portion of the recirculated air into the exhaust portion and passing over the second heat exchanger, wherein the diversion channel includes a first damper controlling a second portion of recirculated air diverted into the air conditioning portion and passing over the first heat exchanger;

wherein the diversion channel includes a second damper controlling the portion of the recirculated air into the exhaust portion and passing over the second heat exchanger.

2. The system of claim 1, further comprising an exhaust damper proximate the exhaust portion configured to control a flow of the portion of the volume of entering the exhaust portion.

3. The system of claim 1, further comprising: an inlet vent proximate the air conditioning portion; and an inlet damper proximate the inlet vent;

wherein the inlet damper is configured to control a flow of external air entering the air conditioning portion.

4. The system of claim 3, further comprising:

an exit vent proximate the air conditioning portion; and an exit damper proximate the exit vent;

wherein the exit vent is configured to control a flow of conditioned air exiting the system.

5. The system of claim 1, further comprising at least one fan arranged within the air conditioning portion configured to force air flow through the air conditioning portion.

6. The system of claim 1, further comprising at least one filter arranged within the air conditioning portion configured to capture particulates from air flowing there-through.

7. The system of claim 1, further comprising at least one fan arranged within the exhaust portion configured to force air flow through the exhaust portion.

8. The system of claim 1, further comprising a compressor in fluid communication with the second heat exchanger and the first heat exchanger through the working fluid.

9. The system of claim 8, further comprising an expansion valve in fluid communication with the first heat exchanger and the second heat exchanger through the working fluid.

* * * * *